US007069936B2

(12) United States Patent
Gueret

(10) Patent No.: US 7,069,936 B2
(45) Date of Patent: Jul. 4, 2006

(54) DEVICE, SYSTEM, AND METHOD FOR APPLYING A COSMETIC PRODUCT, AND METHOD OF MANUFACTURING DEVICE

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 300 days.

(21) Appl. No.: 10/267,599

(22) Filed: Oct. 10, 2002

(65) Prior Publication Data

US 2003/0084913 A1 May 8, 2003

(30) Foreign Application Priority Data

Oct. 10, 2001 (FR) ..... 01 13036

(51) Int. Cl.
*A45D 40/26* (2006.01)

(52) U.S. Cl. ..... 132/218

(58) Field of Classification Search ..... 132/218, 132/320, 317, 318; 15/206; 401/129
See application file for complete search history.

(56) References Cited

U.S. PATENT DOCUMENTS 1,206,273 A * 11/1916 Veeck ..... 15/179
D109,634 S * 5/1938 Beveridge ..... D4/131
2,675,572 A * 4/1954 Nomiya ..... 15/164
4,490,875 A 1/1985 Grunz
4,927,281 A 5/1990 Gueret
5,761,760 A * 6/1998 Dumler et al. ..... 15/206
5,860,432 A * 1/1999 Gueret ..... 132/218
6,029,675 A 2/2000 Dumler
6,033,733 A * 3/2000 Samoil et al. ..... 427/256
6,227,735 B1 5/2001 Gueret

FOREIGN PATENT DOCUMENTS

| | | |
|---|---|---|
| EP | 0 680 707 | 11/1985 |
| EP | 0 611 170 | 8/1994 |
| EP | 0 717 944 | 6/1996 |
| WO | WO 02/07559 | 1/2002 |

* cited by examiner

*Primary Examiner*—John J. Wilson
*Assistant Examiner*—Robyn Doan
(74) *Attorney, Agent, or Firm*—Finnegan, Henderson, Farabow, Garrett & Dunner, LLP

(57) ABSTRACT

A device for applying a cosmetic product may include a first brush portion including a first twisted core holding bristles having ends extending from the first twisted core, and a second brush portion including a second twisted core holding bristles having ends extending from the second twisted core. The first brush portion and the second brush portion may be wound one around the other so that over at least one bristled portion of the device, the first twisted core and the second twisted core are twisted one relative to the other lying a substantially constant distance apart.

118 Claims, 4 Drawing Sheets

DEVICE, SYSTEM, AND METHOD FOR APPLYING A COSMETIC PRODUCT, AND METHOD OF MANUFACTURING DEVICE

The present invention relates to a device for applying a cosmetic product. For example, the device may be configured to apply a cosmetic product (e.g., care products and/or mascara) to an external body portion (e.g., eyelashes and/or eyebrows).

In the field of cosmetic products (e.g., mascara), some commonly used applicators may include brushes sometimes referred to as "twisted brushes." Some twisted brushes may be obtained, for example, by placing a layer of bristles between two branches of a wire (e.g., iron wire) configured in the shape of a hairpin, followed by twisting the two branches of iron wire together about an axis. The twisted branches may form helical turns. In twisted brushes sometimes referred to as "right-hand brushes," when the twisted brush is viewed in a vertical orientation, the helical turns rise from right to left. In twisted brushes sometimes referred to as "left-hand brushes," when the twisted brush is viewed in a vertical orientation, the helical turns rise from left to right. Examples of some left-hand brushes are described in, for example, commonly assigned European Patent No. 0 611 170.

Some twisted brushes may include a "bristled" portion, for example, defining an application portion, which may extend from an "unbristled" portion of the brush (e.g., a part of the brush where the branches do not hold bristles). The unbristled portion is sometimes referred to as the "shank" of the brush and may be, for example, secured to a wand that may be connected to a holding member (e.g., container cap).

In the past fifteen years, there has been an emergence of twisted brushes having varying shapes and cross-sections, including bristles having greater or lesser thicknesses, greater or lesser numbers, and varying nature. Some of these variations may be intended to modify, for example, characteristics of the application of products (e.g., cosmetic products) that may be obtained by using those variations in brushes, some of which may take into consideration, for example, the rheology of a product intended to be applied. For example, depending on the configuration of the twisted brush, it may be possible to alter the loading of product on the twisted brush, the separation of the lashes, their lengthening, and/or their curling (e.g., when applying mascara to eyelashes and/or eyebrows).

European patent application no. EP 0 717 944 discloses an applicator formed by folding a twisted brush onto itself, for example, halfway along its length, and twisting one of the half-branches through 180° about the other half-branch. This may result in an applicator having two loops, which may be intended to form a reservoir for receiving product. At a point of intersection of the half-branches, the distance between the two half-branches approaches zero. This distance then increases gradually on each side of the point of intersection to reach a maximum before decreasing, at one end in the direction of a folding zone, and at the other end in the direction of a zone where the two half-branches are not twisted but are parallel to one another.

One possible drawback associated with such a configuration may stem from its relatively large dimension transverse to its axis, which may pose problems, for example, with inserting and passing the brush into and through a wiping member. Another possible drawback may be associated with automating the manufacture of such a brush.

One subject of the invention relates to providing a device for applying cosmetic product that may offer certain possibilities in the field of cosmetics, for example, applying a cosmetic product to the eyelashes and/or eyebrows. Another subject of the invention relates to providing a device for applying a cosmetic product which may be economical to produce and/or simple to use.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for applying a cosmetic product. The device may include a first brush portion comprising a first twisted core holding bristles having ends extending from the first twisted core, and a second brush portion comprising a second twisted core holding bristles having ends extending from the second twisted core. The first brush portion and the second brush portion may be wound one around the other so that over at least one bristled portion of the device, the first twisted core and the second twisted core are twisted one relative to the other lying a substantially constant distance apart.

According to another aspect, the first twisted core may not be unitary with the second twisted core. This contrasts, for example, with European patent application no. EP 0 717 944, which discloses a unitary core folded over and twisted through 180° to form two open loops. According to some aspects of the present invention, the first and second twisted brush portions may be wound one relative to the other in such a way that their respective twisted cores, for example, over the twisted portion, remain a substantially constant distance apart. A substantially constant distance between the two twisted cores may be obtained, for example, via holding the two first ends of two substantially parallel brush portions under tension and arranged adjacent one another (e.g., as close together as possible) using a first jaw which does not rotate, and holding two second ends of the two brush portions using a jaw which may be rotated relative to the first jaw. The two brush portions may be secured together at, for example, one or more ends of the device.

According to yet another aspect, when the first twisted core and the second twisted core are defined by a common twisted core such that they are unitary, the two brush portions defined by the first and second twisted cores may extend from a bend in the common twisted core. For example, such a bend could be located at substantially the middle of the common twisted core (e.g., when the common twisted core is folded substantially in half) to define the first and second twisted cores. In another example, the first and second brush portions may be defined by a common brush that is folded in half to form a bend.

In yet another aspect, the first brush portion and the second brush portion may each have a free end. For example, the free end of the first brush portion may be located at an end of a bristled portion of the first brush portion (e.g., an end opposite an unbristled portion of the first brush portion), and the free end of the second brush portion may be located at an end of a bristled portion of the second brush portion (e.g., an end opposite an unbristled portion of the second brush portion). The free end of one of the first brush portion and the second brush portion may extend beyond the free end of the other of the first brush portion and the second brush portion (e.g., in the direction of an axis of the device).

According to a further aspect, the first brush portion and the second brush portion may each have an end. The end of the first brush portion and the end of the second brush portion may be connected together. For example, the end of the first brush portion and the end of the second brush portion may be connected together via at least one of welding, brazing, soldering, securing with adhesive, and substantially encasing in at least one of a polymeric material and a metallic material.

According to still another aspect, the first twisted core may be unitary with the second twisted core. For example, the device may include a common (i.e., single) twisted core comprising the first twisted core and the second twisted core. The first twisted core and the second twisted core may be defined by a bend in the common twisted core. Such a bend could be positioned either at an end of a bristled portion of the device (e.g., a free end of the device) or at an end of an unbristled portion of the device (e.g., opposite a free end of the device).

In still another aspect, a device for applying a cosmetic product may include a first brush portion comprising a first twisted core holding bristles having ends extending from the first twisted core, and a second brush portion comprising a second twisted core holding bristles having ends extending from the second twisted core. The first brush portion and the second brush portion may be wound one around the other over at least one bristled portion of the device, and the first twisted core and the second twisted core are not unitary.

As used herein, when the first and second twisted cores are "not unitary," they are not defined by portions of a single, common core. Rather, first and second twisted cores that are "not unitary" are structures that have been associated with one another (e.g., through the winding of one around the other and possibly also some additional connection at one or more of their ends after having been separate from one another).

According to yet another aspect, a device for applying a cosmetic product may include a first brush portion comprising a first twisted core holding bristles having ends extending from the first twisted core. The first brush portion may include a free end defined by a bristled portion of the first brush portion. The device may include a second brush portion comprising a second twisted core holding bristles having ends extending from the second twisted core. The second brush portion may include a free end defined by a bristled portion of the second brush portion. The first brush portion and the second brush portion may be wound one around the other so that over the bristled portion of at least one of the first brush portion and the second brush portion, the first twisted core and the second twisted core are twisted one relative to the other.

In an additional aspect, a device for applying a cosmetic product may include a first brush portion comprising a first twisted core holding bristles having ends extending from the first twisted core, and a second brush portion comprising a second twisted core holding bristles having ends extending from the second twisted core. An end of a bristled portion of the first brush portion and an end of a bristled portion of the second brush portion may be connected together, and the first brush portion and the second brush portion may be wound one around the other so that over the bristled portion of at least one of the first brush portion and the second brush portion, the first twisted core and the second twisted core are twisted one relative to the other.

According to yet another aspect, a device for applying a cosmetic product may include a first brush portion comprising a first twisted core holding bristles having ends extending from the first twisted core, and a second brush portion comprising a second twisted core holding bristles having ends extending from the second twisted core. The first brush portion and the second brush portion may be wound one around the other so that over at least one bristled portion of the device, the first twisted core and the second twisted core are twisted one relative to the other.

In an additional aspect, the first brush portion and the second brush portion may be wound one around the other for at least one turn. For example, the first twisted core and the second twisted core may be wound one around the other for one full turn, greater than one full turn, at least one and one-half turns, at least two turns, etc. Before being twisted one around the other, the two brush portions may have substantially the same overall lengths and/or the respective lengths of their bristled portions and of their unbristled portions may be substantially the same.

In another aspect, the first brush portion and the second brush portion may each have a free end. The free end of one of the first brush portion and the second brush portion may extend beyond the free end of the other of the first brush portion and the second brush portion (e.g., in the direction of an axis of the device).

The brush portions may have their respective bristled portions and their respective unbristled portions in substantial axial superposition and/or axial offset during twisting so that the twisted cores of the two brush portions may be twisted one relative to the other only over a portion of the total length of the bristled portion of the device. In some aspects, it may be possible to generate numerous new geometries and configurations of bristles, which may offer a corresponding number of novel possibilities in the terms of making-up. These geometries and configurations may stem, for example, from the fact that as the first brush portion is twisted relative to the second brush portion, the turns of each of the brush portions may nestle together, become partially crushed and, as a result, behave in a different way, for example, when they are engaged with the eyelashes or eyebrows for applying a cosmetic product. The degree of imbrication of the turns of the first and second brush portions with respect to one another may be selected based on numerous parameters and, for example, on the configuration of each of the first and second brush portions, and/or on the manner in which they are twisted one relative to the other (e.g., the pitch of the twist). For example, each brush portion may not be wound around the other brush portion (e.g., one brush portion may remain substantially non-wound while the other brush portion winds around the substantially non-wound brush portion). In other examples, each brush portion may be wound around the other brush portion to at least some degree.

In an additional aspect, the first twisted core and the second twisted core may each comprise a twisted unbristled portion (e.g., extending from a twisted bristled portion). The device may include an unbristled device portion defined by the twisted unbristled portions. The bristled portion of the device may be located adjacent (e.g., abutting) the unbristled device portion. For example, the unbristled device portion may be formed of four twisted strands of wire, wherein two of the strands are pre-twisted to define the unbristled portion of the first brush portion and the other two strands are pre-twisted to define the unbristled portion of the second brush portion. Optionally, each strand may be iron wire.

According to another aspect, the device may include a wand and a cap. The unbristled device portion may be secured to the wand and the wand may extend from the cap. For example, the wand may be secured to the cap.

As used herein, structures "secured" to each other are connected together such that they do not separate from each other in an unintended manner under normal conditions of use.

For example, the device may be mounted on the wand by inserting an end (e.g., a shank end) of the device into a bore (e.g., a blind bore) defined in the axis of the wand. The end of the wand (e.g., the shank end) may be heated, for example, so as to soften the material (e.g., a thermoplastic) that the wand may comprise and that may render it easier for the device to be mounted on the wand. In some aspects, the device may include a cap that may be unitary with the wand.

In still another aspect, the first brush portion may define a section in a plane containing the first twisted core and the second brush portion may define a section in a plane containing the second twisted core. The section of the first brush portion may be substantially the same as the section of the second brush portion, for example, before the first brush portion and the second brush portion are wound one around the other. For example, the first and second brush portions may be cylindrical-shaped, frustoconical-shaped, or cylindro-conical-shaped.

In an additional aspect, the first brush portion may define a section in a plane containing the first twisted core and the second brush portion may define a section in a plane containing the second twisted core. The section of the first brush portion may differ from the section of the second brush portion, for example, before the first brush portion and the second brush portion are wound one around the other. For example, the first brush portion may be cylindro-frustoconical-shaped, and the second brush portion may be peanut-shaped.

According to another aspect, the first brush portion and the second brush portion may be "right-hand" brush portions. In some aspects, the first brush portion and the second brush portion may be "left-hand" brush portions. According to yet another aspect, the first brush portion may be a "right-hand" brush portion and the second brush portion may be a "left-hand" brush portion.

As used herein, the term "right-hand" brush portion refers to a brush portion comprising a twisted core defining helical turns, wherein, when an observer views the brush portion while it is oriented substantially vertically, the helical turns rise from the right to the left. As used herein, the term "left-hand" brush portion refers to a brush portion comprising a twisted core defining helical turns, wherein, when an observer views the brush portion while it is oriented substantially vertically, the helical turns rise from the left to the right.

In another aspect, the first twisted core and the second twisted core may each define a direction of twist. The first brush portion and the second brush portion may be wound one around the other in the same direction as the direction of twist of the first twisted core and the second twisted core. For example, the "combined twist" or "double twist" formed by the first twisted core relative to the second twisted core may have the same orientation (e.g., hand) as the orientation of twist of first and second twisted cores.

In an additional aspect, the first twisted core and the second twisted core may each define a direction of twist, and the first brush portion and the second brush portion may be wound one around the other in a direction opposite to the direction of twist of the first twisted core and the second twisted core. For example, the "combined twist" or "double twist" formed by the first twisted core relative to the second twisted core may have an orientation (e.g., "hand") that is opposite to the orientation of twist of first and second twisted cores.

In still another aspect, the bristles of the first brush portion may include bristles having a color differing from that of at least some of the bristles of the second brush portion. For example, the bristles of the first brush portion may be white while at least some of the bristles of the second brush portion may be black.

In an additional aspect, the first twisted core may include two branches of a first wire and the second twisted core may include two branches of a second wire. The first wire and the second wire may be substantially the same. In some aspects, at least one of the first wire and the second wire may include iron. The diameter of the wire of each of the two brush portions may range from about 0.2 millimeter to about 1.5 millimeters (e.g., from about 0.3 millimeter to about 0.8 millimeters).

According to yet another aspect, the first twisted core may include two branches of a first wire, and the second twisted core may include two branches of a second wire, wherein the first wire and the second wire differ from each other. For example, the first and second wires (e.g., iron wires) may have different diameters and/or characteristics (e.g., the first wire may have a diameter of about 0.45 millimeter and the second wire may have a diameter of about 0.7 millimeter).

In still another aspect, the bristles of the first brush portion may define at least one of a number of bristles, diameter, length, and characteristic, and the bristles of the second brush portion may define at least one of a number of bristles, diameter, length, and characteristic. The at least one of the number of bristles, the diameter, the length, and the characteristic of the bristles of the first brush portion may be different from at least one of the number of bristles, the diameter, the length, and the characteristic of the bristles of the second brush portion. For example, the bristles of the first brush portion may include nylon-6,6, nylon-6,10, and/or nylon-6,11. The bristles of the second brush portion may include, for example, an elastomer. In some embodiments, additives (e.g., bactericidal agents, magnetic charges, and/or slip agent types) may be included in material(s) (e.g., thermoplastic material(s)) forming at least some of the bristles, for example, so as to alter their mechanical and/or chemical properties. For example, the diameter of the bristles of the first brush portion may range from about 0.1 millimeters to about 0.17 millimeters, and bristles of the second brush portion may have a diameter of about 0.25 millimeters. The number of bristles on the first brush portion may range, for example, from 10 to 40 per turn (e.g., of a helix) and the number of bristles on the second brush portion may be, for example, less than about 10 per turn.

In an additional aspect, the bristles of the first brush portion may define at least one of a number of bristles, diameter, length, and characteristic, and the bristles of the second brush portion may define at least one of a number of bristles, diameter, length, and characteristic. The at least one of the number of bristles, the diameter, the length, and the characteristic of the bristles of the first brush portion may be substantially the same as at least one of the number of bristles, the diameter, the length, and the characteristic of the bristles of the second brush portion.

By influencing each of these parameters discussed hereinabove (e.g., number of bristles, diameter, length, and/or characteristic) either in combination or separately, the number of possible variations in applying a cosmetic product may be multiplied. For example, the variations may be multiplied by influencing the shape of the ends of the bristles of one and/or the other of the brush portions. The ends of the bristles of one and/or the other of the brush portions may be configured in the shape of balls, hooks, and/or have other characteristics such as roughnesses via, for example, a treatment (e.g., heat treatment, chemical treatment, and/or mechanical treatment).

In another aspect, a system for applying a product may include a device for applying a cosmetic product and a container comprising a wiper. The container may define an opening associated with the wiper. In some aspects, the system may include a product contained in the container, wherein the product may comprise a cosmetic product. In some aspects, the product may comprise a product for applying to keratinous fibers (e.g., eyelashes and eyebrows). The product may have a liquid-to-pasty consistency or a solid consistency.

According to another aspect, a method of applying a product to keratinous fibers may include providing the system for applying a product, loading the device of the system with the cosmetic product, and applying the cosmetic product to keratinous fibers with the device.

The term "providing" is used in a broad sense, and refers to, but is not limited to, making available for use, manufacturing, enabling usage, giving, supplying, obtaining, getting a hold of, acquiring, purchasing, selling, distributing, possessing, making ready for use, forming and/or obtaining intermediate product(s), and/or placing in a position ready for use.

In yet another aspect, the device for applying a cosmetic product may include a first brush portion comprising a bristled portion and a second brush portion comprising a bristled portion, wherein the device is formed via winding the first brush portion and the second brush one around the other along at least a portion of the bristled portions of the first brush portion and the second brush portion.

In an additional aspect, a method of manufacturing a device for applying a cosmetic product may include providing a first brush portion comprising a first twisted core having a bristled portion holding bristles having ends extending from the first twisted core, providing a second brush portion comprising a second twisted core having a bristled portion holding bristles having ends extending from the second twisted core, and winding the first brush portion and the second brush portion one around the other so that over at least one bristled portion of the device. The first twisted core and the second twisted core may be twisted one relative to the other lying a substantially constant distance apart. After twisting, for example, the device may undergo a certain number of different operations such as, for example, "trimming" operations (e.g., using a trimmer) so as to alter the shape of the brush portion(s), and/or operations aimed at curving the device in at least one plane so as to curve it.

According to yet another aspect, the method of manufacturing the device may include connecting an end of the first brush portion to an end of the second brush portion via at least one of welding, brazing, soldering, securing with adhesive, and encasing in at least one of a polymeric material and a metallic material. For example, once the two brush portions have been twisted, the free ends (e.g., when the brush portions are not unitary with each other) of the twisted core of each of the two brush portions may be joined together by, for example, a structure in the form of a plug (e.g., a plug comprising at least one of a thermoplastic material and a metallic material). Such a plug may render the device less harmful to the eye (e.g., in the event of the end of the device inadvertently contacting the eye).

In an additional aspect, the method may include unitarily forming the first twisted core and the second twisted core from a common twisted core. For example, forming the first twisted core and the second twisted core may include bending the common twisted core.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic view of an embodiment of a device for applying a cosmetic product comprising embodiments of first and second brush portions shown on the left side of the view;

Reference will now be made in detail to some possible embodiments of the invention, examples of which are illustrated in the accompanying drawings. Wherever possible, the same reference numbers are used in the drawings and the description to refer to the same or like parts.

Figure 1:
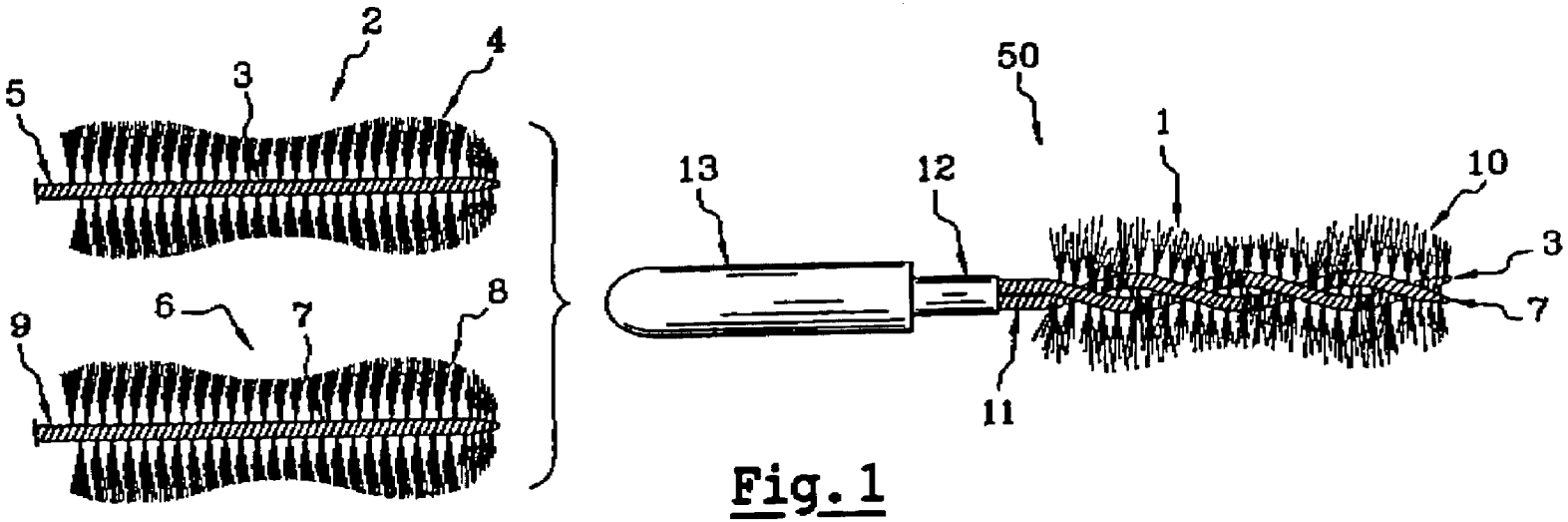

The exemplary embodiment of a device 1 depicted in FIG. 1 may include a first brush portion 2 and a second brush portion 6. The first brush portion 2 may include, for example, a twisted core 3 comprising a bristled portion 4 formed (e.g., cut) in the shape of, for example, a peanut, in which the bristles may be arranged radially with respect to the axis of the first brush portion 2. An unbristled portion 5 may be located substantially adjacent to the bristled portion 4. The first brush portion 2 may be a right-hand brush portion.

The second brush portion 6 may include a twisted core 7 comprising a bristled portion 8 formed (e.g., cut) in the shape of, for example, a peanut, in which the bristles may be arranged radially with respect to the axis of the second brush portion 6. An unbristled portion 9 may be located substantially adjacent to the bristled portion 8. The second brush portion 6 may be a right-hand brush portion.

In some exemplary embodiments of the device 1, the first and second brush portions 2 and 6 may be placed side by side, for example, by arranging the ends of the respective unbristled portions 5 and 9 of the first and second brush portions 2 and 6 in a jaw which does not rotate. The respective ends of the bristled portions 4 and 8 of the first and second brush portions 2 and 6 may be arranged, for example, in a second jaw that may be rotated via a motor turning in, for example, a counter-clockwise direction. The first and second twisted cores 3 and 7 of the first and second brush portions 2 and 6, respectively, may be wound one around the other (e.g., to form a helix running in a direction opposite to the direction of a helix of which each of the first and second twisted cores may be formed). Once the first and second brush portions 2 and 6 have been twisted together, the combined device 1 may be trimmed, for example, by means of a cutting tool (e.g., to alter its shape, to give it a desired look, and/or to give it desired application properties). The resulting device 1 may have a bristled portion 10 and an unbristled portion 11 substantially adjacent to (e.g., abutting) the bristled portion 10. The end of the unbristled portion 11 may be located in, for example, a blind hole formed axially at the end of a wand 12. The wand 12 may be secured to a cap 13. In some embodiments, the wand 12 may be unitarily formed with the cap 13. An application unit 50 thus formed may be used, for example, as part of a system for applying a product which will be described hereinafter.

The bristled portion 10 of the device 1 may include a number of turns imbricated in one another to some extent (e.g., allowing application characteristics which may differ from application characteristics that may be obtained individually with each of the first and second brush portions 2 and 6).

Figure 2:
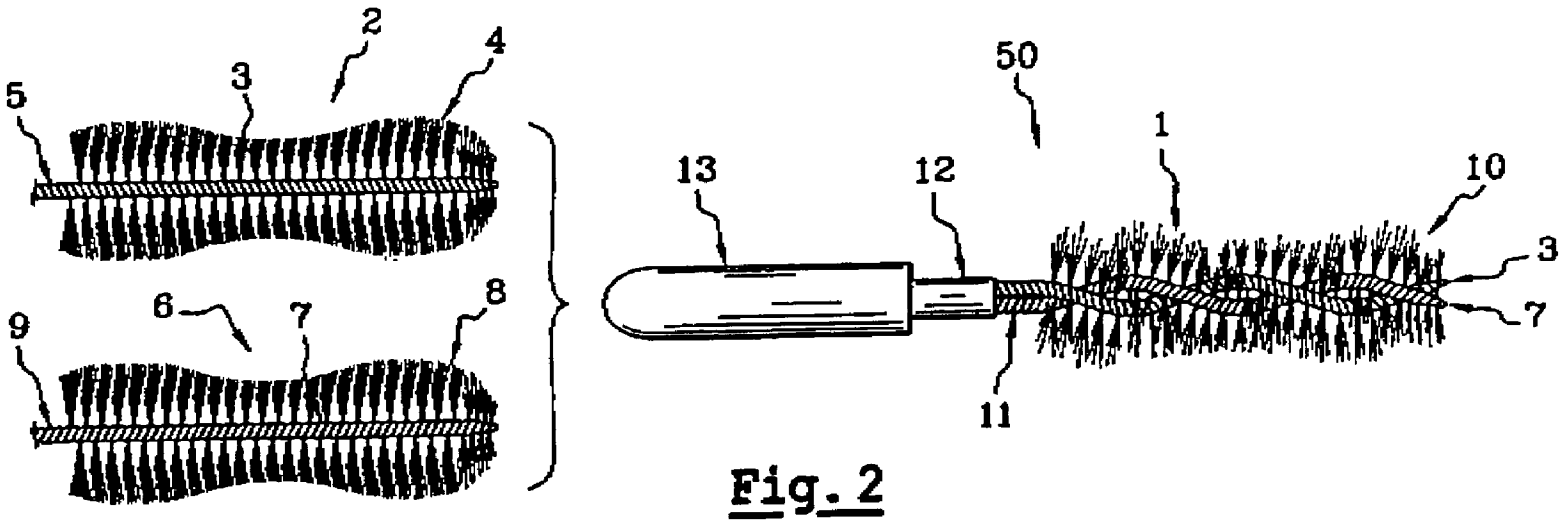
FIG. 2 is a schematic view of another embodiment of a device for applying a cosmetic product comprising embodiments of first and second brush portions shown on the left side of the view.

FIG. 2 depicts an exemplary embodiment of a device 1 for applying a product that may include a first brush portion 2 that is a left-hand brush portion, and a second brush portion 6 that is a right-hand brush portion.

The arrangement of bristles according to some embodiments of the device 1 may be obtained by, for example, twisting together the first and second brush portions 2 and 6, and may possess a different degree of imbrication of the turns, which may be, for example, significantly more pronounced. This may yield a different product application characteristic.

Figure 3:
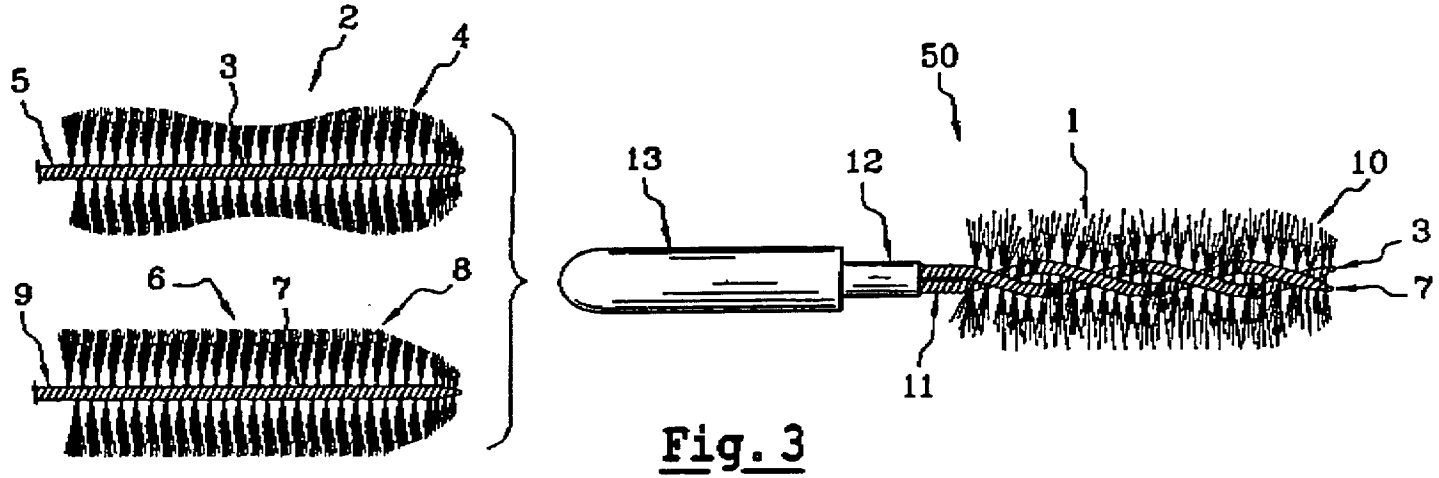
FIG. 3 is a schematic view of a further embodiment of a device for applying a cosmetic product comprising embodiments of first and second brush portions shown on the left side of the view.

FIG. 3 depicts an exemplary embodiment of a device 1 which may include, for example, a bristled portion 4 of the first brush portion 2 that is in, for example, the shape of a peanut, and a bristled portion 8 of the second brush portion 6 that is substantially cylindrical over at least the majority of its length. The second brush portion 6 may include a portion near an end opposite to the shank 9 which defines, for example, a substantially frustoconical shape.

Twisting the first and second brush portions 2 and 6 together, for example, in the manner mentioned earlier with reference to the exemplary embodiments of FIGS. 1 and 2, may result in an arrangement of bristles different from arrangements obtained previously. Such an arrangement may be notable, for example, by the presence of shorter and longer bristles.

Figure 4:
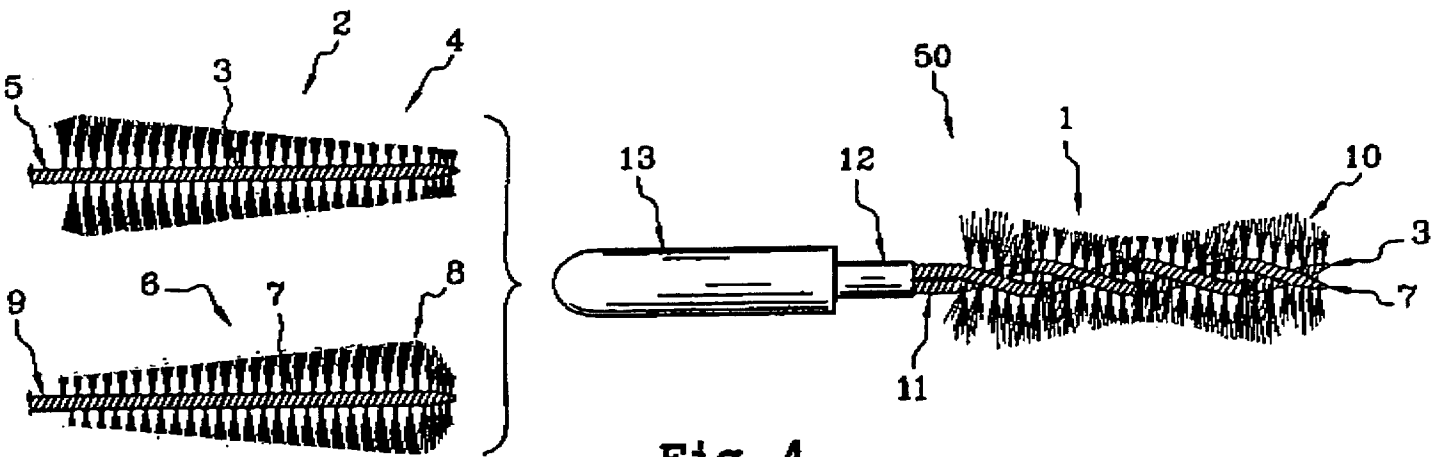
FIG. 4 is a schematic view of another embodiment of a device for applying a cosmetic product comprising embodiments of first and second brush portions shown on the left side of the view.

FIG. 4 depicts an exemplary embodiment of a device 1 for applying a product that may include, for example, a bristled portion 4 of the first brush portion 2 that has a cross-section that decreases gradually from the shank 5 toward the free end of its bristled portion 4, and a bristled portion 8 of the second brush portion 6 that has a cross-section that increases gradually from the shank 9 to the free end of its bristled portion 8.

Figure 5:
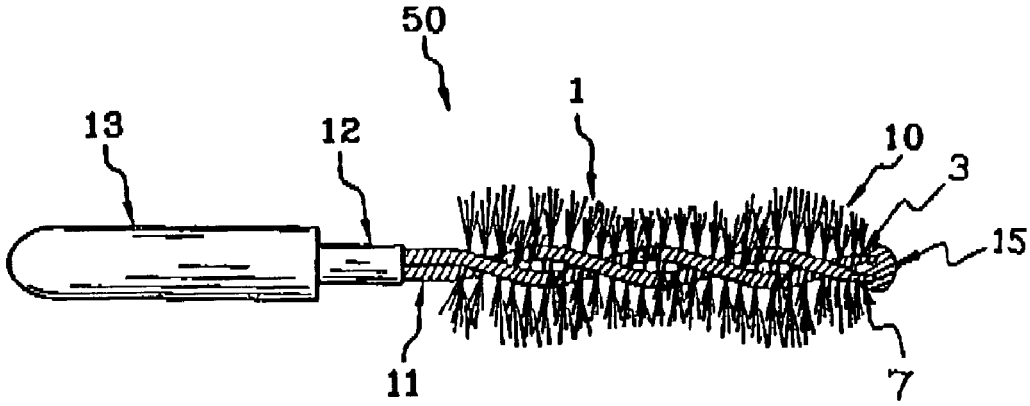
FIG. 5 is a schematic view of an embodiment of a further device for applying a cosmetic product.

FIG. 5 depicts an exemplary embodiment of a device for applying a product that may include a first brush portion 2 and a second brush portion 6. The first brush portion 2 may include a first twisted core 3 and the second brush portion 6 may include a second twisted core 7. The free ends of the first twisted core 3 and the second twisted core 7 may be connected together via a connection 15. The connection 15 may include, for example, at least one of welding, brazing, soldering, securing with adhesive, and substantially encasing in at least one of a polymeric material and a metallic material. Other connections, of course, are possible.

Figure 6:
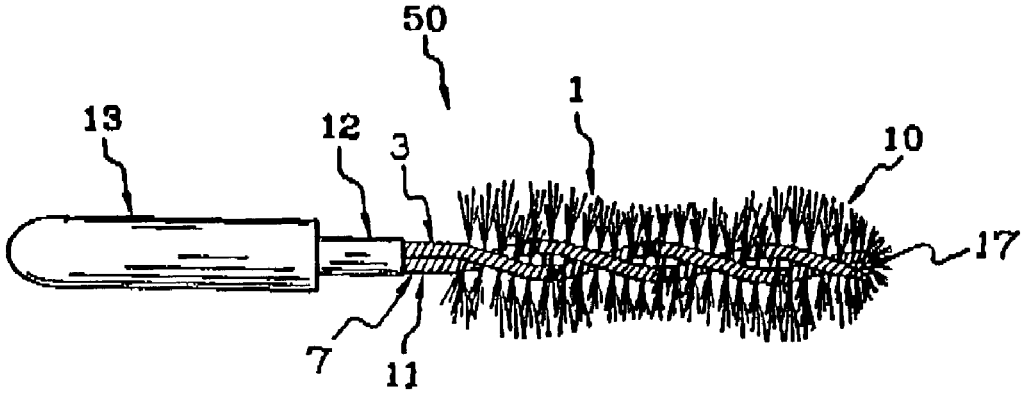
FIG. 6 is a schematic view of another embodiment of a device for applying a cosmetic product.

FIG. 6 depicts an exemplary embodiment of a device 1 for applying a product that may include a first brush portion 2 and a second brush portion 6. The first brush portion 2 may include a first twisted core 3 and the second brush portion 6 may include a second twisted core 7. The first twisted core and the second twisted core may be unitarily formed from, for example, a common twisted core 18 (e.g., via bending the common twisted core at, for example, bend 17 such that the first twisted core 3 and the second twisted core 7 are formed).

In another embodiment (not shown), a device similar to that of any of FIGS. 1-5 may be formed from a common core (e.g., a common core having a bend embedded in wand 12).

Figure 7:
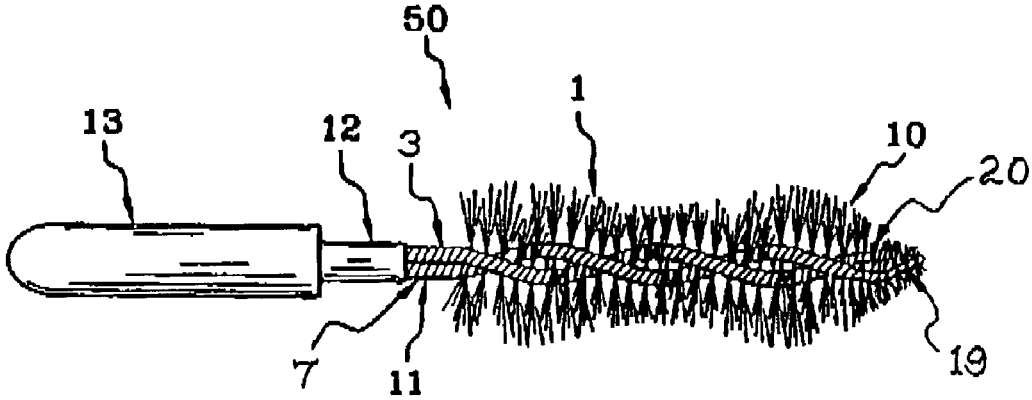
FIG. 7 is a schematic view of a further embodiment of a device for applying a cosmetic product.

FIG. 7 depicts an exemplary embodiment of a device 1 for applying a product that may include brush portions having a first twisted core 3 and a second twisted core 7. One of the first and second brush portions may have a free end 19 that extends beyond a free end 20 of the other brush portion in the direction of an axis of the device 1. For example, the end of one twisted core may extend beyond the end of another twisted core.

Figure 8A:
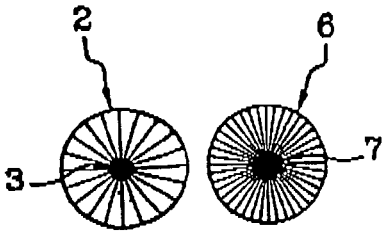
FIG. 8A is a schematic cross-section view of first and second brush portions of an embodiment of a device for applying a cosmetic product.

Some exemplary embodiments of a device 1 for applying a product may include a first brush portion 2 and a second brush portion 6 that may have substantially the same cross sections while, for example, the bristle density of the first brush portion 2 may be lower than the bristle density of the second brush portion 6, as depicted in FIG. 8A.

Figure 8B:
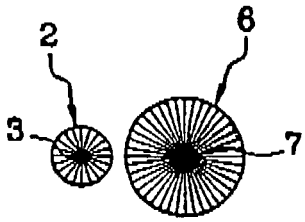
FIG. 8B is a schematic cross-section view of first and second brush portions of another embodiment of a device for applying a cosmetic product.

As shown in FIG. 8B, some embodiments of a device 1 for applying a product may include first 2 and second 6 brush portions which have substantially the same bristle densities, and the first brush portion 2 may have a smaller cross-section than the second brush portion 6.

Figure 8C:
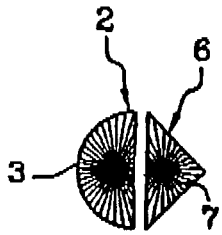
FIG. 8C is a schematic cross-section view of first and second brush portions of a further embodiment of a device for applying a cosmetic product.

FIG. 8C depicts an exemplary embodiment in which a first brush portion 2 may form, for example, a half-cylinder having one substantially planar face, which may, when twisted around a second brush portion 6, face a substantially planar face of a generally triangular-shaped cross-section formed by the second brush portion 6.

Figure 8D:
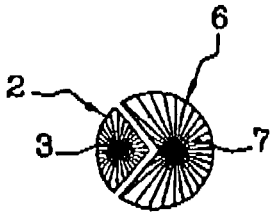
FIG. 8D is a schematic cross-section view of first and second brush portions of another embodiment of a device for applying a cosmetic product.

FIG. 8D depicts an exemplary embodiment in which a first brush portion 2 may include a cross-section which extends, for example, over an angular range (e.g., of about 100°). A second brush portion 6 may include, for example, a cross-section which extends, for example, over an angular range (e.g., of about 240°). In some embodiments, the first brush portion 2 and the second brush portion 6 may be wound one around the other such that the shapes (e.g., cross-sections) of the first brush portion 2 and the second brush portion 6 are substantially complimentary with each other such that, for example, the shape of the first brush portion 2 may be considered to be the "missing quarter" of the second brush portion 6 (e.g., collectively forming a substantially circular-shaped cross-section).

Figure 8E:
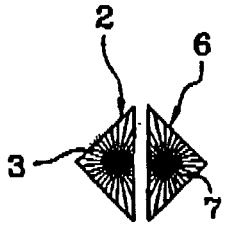
FIG. 8E is a schematic cross-section view of first and second brush portions of a further embodiment of a device for applying a cosmetic product.

FIG. 8E depicts an exemplary embodiment that may include two brush portions (e.g., a first brush portion 2 and a second brush portion 6) each having a cross-section which may form an isosceles triangle, each having, for example, a face opposite the vertex connecting the two identical sides placed in a substantially face-to-face relationship prior to twisting the two brush portions one around the other.

Figure 9:
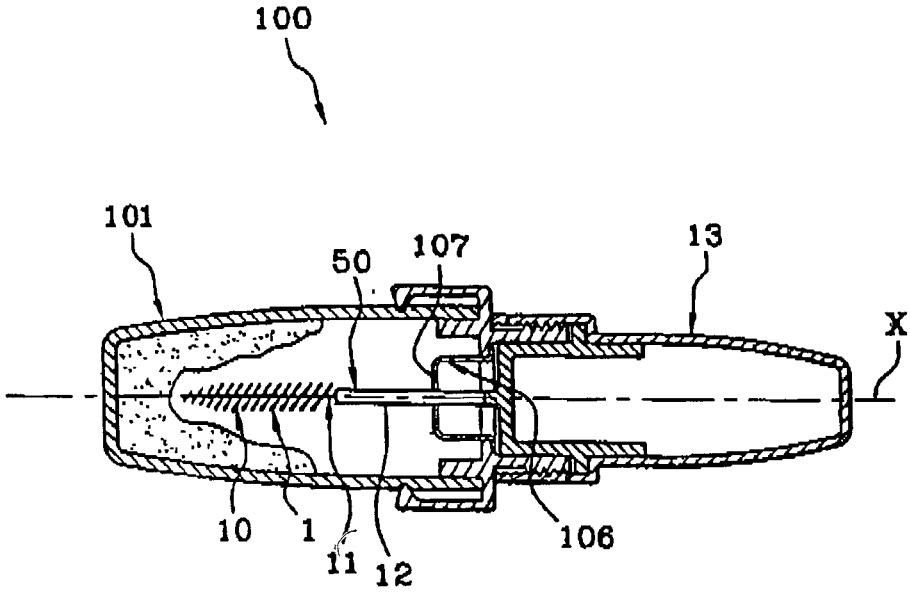
FIG. 9 is a partial schematic section view of an embodiment of a system for applying a cosmetic product.

FIG. 9 depicts an exemplary embodiment of a system 100 for applying a product which may be equipped with a device 1 such as one of the exemplary embodiments described hereinabove. The system 100 may include a container 101 containing, for example, a cosmetic product (e.g., mascara) and an application unit 50. The application unit 50 may include a device 1 (e.g., a twisted brush portion-type), fixed to one end of a wand 12 having an axis X. The other end of the wand 12 may be secured to an element 13 for grasping, which may also serve, for example, as a cap for sealing the container 101. In some embodiments, the wand 12 and the element for grasping 13 may be unitary with each other. The container 101 may include member 106 having a cylindrical sleeve including, for example, one end which may terminate a lip 107, for example, a flexible annular lip forming a wiper. In some embodiments, when the application unit 50 is placed fully in (e.g., mounted on) the container 101, the device 1 may be located between the lip 107 and a bottom of the container 101.

It should be understood that there are many alternative structural configurations, other than the member 106 having a lip 107, that could be used to provide a wiper. For example, the device could include a block of open-cell foam and/or semi-open-cell foam through which an axial slot or passage may be formed. Such a slot or passage may include edges that may be configured such that they are substantially contiguous (e.g., not separated) when unstressed (e.g., when a device 1 is not received in the axial slot or passage).

When using some embodiments of the system 100 for applying a product, the user may unscrew the element for grasping 13 (e.g., cap) and extract the application unit 50 from the container 101. The device 1 may be made to pass through, for example, a member 106 (e.g., a wiper), so as to regulate the amount of product loaded onto the bristles. The movement of extracting the device 1 may occur in a substantially longitudinal manner with respect to the axis X. After use, the user may return the application unit 50 to the container 101 (e.g., passing the device 1 through the member 106).

The device according to some exemplary embodiments of the invention may be used to dispense cosmetic products, such as care products, make-up products, dermatological substances, and/or pharmaceutical compositions used for treating and/or changing the appearance of keratinous fibers. However, in its broadest aspects, the present invention could be used to dispense many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a cosmetic product, the device comprising:

a first brush portion comprising a first twisted core holding bristles having ends extending from the first twisted core; and a second brush portion comprising a second twisted core holding bristles having ends extending from the second twisted core, wherein the first brush portion and the second brush portion are wound one around the other so that over at least one bristled portion of the device, the first twisted core and the second twisted core are twisted one relative to the other lying a substantially constant distance apart.

2. The device of claim 1, wherein the first brush portion and the second brush portion are wound one around the other for at least one turn.

3. The device of claim 1, wherein the first twisted core is not unitary with the second twisted core.

4. The device of claim 1, wherein the first brush portion and the second brush portion each have a free end, and wherein the free end of one of the first brush portion and the second brush portion extends beyond the free end of the other of the first brush portion and the second brush portion in the direction of an axis of the device.

5. The device of claim 1, wherein the first brush portion and the second brush portion each have an end, the end of the first brush portion and the end of the second brush portion being connected together.

6. The device of claim 1, wherein the first brush portion and the second brush portion each have an end, the end of the first brush portion and the end of the second brush portion being connected together via at least one of welding, brazing, soldering, securing with adhesive, and substantially encasing in at least one of a polymeric material and a metallic material.

7. The device of claim 1, wherein the first twisted core is unitary with the second twisted core.

8. The device of claim 7, wherein the device comprises a common twisted core comprising the first twisted core and the second twisted core, wherein the first twisted core and the second twisted core are defined by a bend in the common twisted core.

9. The device of claim 1, wherein the first twisted core and the second twisted core are wound one around the other for at least one and one-half turns.

10. The device of claim 1, wherein the first twisted core and the second twisted core are wound one around the other for at least two turns.

11. The device of claim 1, wherein the first twisted core and the second twisted core each comprise a twisted unbristled portion, wherein the device comprises an unbristled device portion defined by the twisted unbristled portions, the bristled portion of the device being located adjacent the unbristled device portion.

12. The device of claim 11, further comprising a wand and a cap, wherein the unbristled device portion is secured to the wand and the wand extends from the cap.

13. The device of claim 1, further comprising a wand, wherein the first brush portion and the second brush portion are secured to the wand.

14. The device of claim 13, further comprising a cap, wherein the wand is secured to the cap.

15. The device of claim 13, further comprising a cap unitary with the wand.

16. The device of claim 1, wherein the first brush portion defines a section in a plane containing the first twisted core and the second brush portion defines a section in a plane containing the second twisted core, wherein the section of the first brush portion is substantially the same as the section of the second brush portion before the first brush portion and the second brush portion are wound one around the other.

17. The device of claim 1, wherein the first brush portion defines a section in a plane containing the first twisted core and the second brush portion defines a section in a plane containing the second twisted core, wherein the section of the first brush portion differs from the section of the second brush portion before the first brush portion and the second brush portion are wound one around the other.

18. The device of claim 1, wherein the first brush portion and the second brush portion are right-hand brush portions.

19. The device of claim 18, wherein the first twisted core and the second twisted core each define a direction of twist, the first brush portion and the second brush portion being wound one around the other in the same direction as the direction of twist of the first twisted core and the second twisted core.

20. The device of claim 18, wherein the first twisted core and the second twisted core each define a direction of twist, the first brush portion and the second brush portion being wound one around the other in a direction opposite to the direction of twist of the first twisted core and the second twisted core.

21. The device of claim 1, wherein the first brush portion and the second brush portion are left-hand brush portions.

22. The device of claim 21, wherein the first twisted core and the second twisted core each define a direction of twist, the first brush portion and the second brush portion being wound one around the other in the same direction as the direction of twist of the first twisted core and the second twisted core.

23. The device of claim 21, wherein the first twisted core and the second twisted core each define a direction of twist, the first brush portion and the second brush portion being wound one around the other in a direction opposite to the direction of twist of the first twisted core and the second twisted core.

24. The device of claim 1, wherein the first brush portion is a right-hand brush portion and the second brush portion is a left-hand brush portion.

25. The device of claim 1, wherein the bristles of the first brush portion comprise bristles having a color differing from that of at least some of the bristles of the second brush portion.

26. The device of claim 1, wherein the first twisted core comprises two branches of a first wire and the second twisted core comprises two branches of a second wire, wherein the first wire and the second wire are substantially the same.

27. The device of claim 1, wherein at least one of the first wire and the second wire comprises iron.

28. The device of claim 1, wherein the first twisted core comprises two branches of a first wire, and the second twisted core comprises two branches of a second wire, wherein the first wire and the second wire differ from each other.

29. The device of claim 1, wherein the bristles of the first brush portion define at least one of a number of bristles, diameter, length, and characteristic, and the bristles of the second brush portion define at least one of a number of bristles, diameter, length, and characteristic, and wherein at least one of the number of bristles, the diameter, the length, and the characteristic of the bristles of the first brush portion is different from at least one of the number of bristles, the diameter, the length, and the characteristic of the bristles of the second brush portion.

30. The device of claim 1, wherein the bristles of the first brush portion define at least one of a number of bristles, diameter, length, and characteristic, and the bristles of the second brush portion define at least one of a number of bristles, diameter, length, and characteristic, and wherein at least one of the number of bristles, the diameter, the length, and the characteristic of the bristles of the first brush portion is substantially the same as at least one of the number of bristles, the diameter, the length, and the characteristic of the bristles of the second brush portion.

31. A system for applying a product, the system comprising:

the device of claim 1; and a container comprising a wiper, wherein the container defines an opening associated with the wiper.

32. The system of claim 31, further comprising a product contained in the container, wherein the product comprises a cosmetic product.

33. The system of claim 32, wherein the product comprises a product for applying to keratinous fibers.

34. A method of applying a product to keratinous fibers, the method comprising:

providing the system of claim 32;

loading the device with the cosmetic product; and applying the cosmetic product to keratinous fibers with the device.

35. The device of claim 1, wherein the first brush portion comprises a bristled portion and the second brush portion comprises a bristled portion, wherein the device is formed via winding the first brush portion and the second brush one around the other along at least a portion of the bristled portions of the first brush portion and the second brush portion.

36. A method of manufacturing a device for applying a cosmetic product, the method comprising:

providing a first brush portion comprising a first twisted core having a bristled portion holding bristles having ends extending from the first twisted core;

providing a second brush portion comprising a second twisted core having a bristled portion holding bristles having ends extending from the second twisted core; and winding the first brush portion and the second brush portion one around the other so that over at least one bristled portion of the device, the first twisted core and the second twisted core are twisted one relative to the other lying a substantially constant distance apart.

37. The method of claim 36, wherein the first twisted core and the second twisted core are not unitary with each other.

38. The method of claim 36, further comprising connecting an end of the first brush portion to an end of the second brush portion via at least one of welding, brazing, soldering, securing with adhesive, and encasing in at least one of a polymeric material and a metallic material.

39. The method of claim 36, wherein the method further comprises unitarily forming the first twisted core and the second twisted core from a common twisted core.

40. The method of claim 39, wherein forming the first twisted core and the second twisted core comprises bending the common twisted core.

41. A device for applying a cosmetic product, the device comprising:

a first brush portion comprising a first twisted core holding bristles having ends extending from the first twisted core; and a second brush portion comprising a second twisted core holding bristles having ends extending from the second twisted core, wherein the first brush portion and the second brush portion are wound one around the other over at least one bristled portion of the device, and the first twisted core and the second twisted core are not unitary, and wherein the first twisted core and the second twisted core are wound one around the other for at least one and one-half turns.

42. The device of claim 41, wherein the first brush portion and the second brush portion each have a free end.

43. The device of claim 41, wherein an end of the first brush portion and an end of the second brush portion are connected together.

44. The device of claim 41, wherein an end of the first brush portion and an end of the second brush portion are connected together via at least one of welding, brazing, soldering, securing with adhesive, and substantially encasing in at least one of a polymeric material and a metallic material.

45. The device of claim 41, wherein the first twisted core and the second twisted core are twisted one relative to the other lying a substantially constant distance apart.

46. The device of claim 42, wherein the free end of one of the first brush portion and the second brush portion extends beyond the free end of the other of the first brush portion and the second brush portion in the direction of an axis of the device.

47. The device of claim 41, wherein the first twisted core and the second twisted core are wound one around the other for at least two turns.

48. The device of claim 41, wherein the first twisted core and the second twisted core each comprise a twisted unbristled portion, wherein the device comprises an unbristled device portion defined by the twisted unbristled portions, the bristled portion of the device being located adjacent the unbristled device portion.

49. The device of claim 48, further comprising a wand and a cap, wherein the unbristled device portion is secured to the wand and the wand extends from the cap.

50. The device of claim 41, further comprising a wand, wherein the first brush portion and the second brush portion are secured to the wand.

51. The device of claim 50, further comprising a cap secured to the wand.

52. The device of claim 50, further comprising a cap unitary with the wand.

53. The device of claim 41, wherein the first brush portion defines a section in a plane containing the first twisted core and the second brush portion defines a section in a plane containing the second twisted core, wherein the section of the first brush portion is substantially the same as the section of the second brush portion before the first brush portion and the second brush portion are wound one around the other.

54. The device of claim 41, wherein the first brush portion defines a section in a plane containing the first twisted core and the second brush portion defines a section in a plane containing the second twisted core, wherein the section of the first brush portion differs from the section of the second brush portion before the first brush portion and the second brush portion are wound one around the other.

55. The device of claim 41, wherein the first brush portion and the second brush portion are right-hand brush portions.

56. The device of claim 55, wherein the first twisted core and the second twisted core each define a direction of twist, the first brush portion and the second brush portion being wound one around the other in the same direction as the direction of twist of the first twisted core and the second twisted core.

57. The device of claim 55, wherein the first twisted core and the second twisted core each define a direction of twist, the first brush portion and the second brush portion being wound one around the other in a direction opposite to the direction of twist of the first twisted core and the second twisted core.

58. The device of claim 41, wherein the first brush portion and the second brush portion are left-hand brush portions.

59. The device of claim 58, wherein the first twisted core and the second twisted core each define a direction of twist, the first brush portion and the second brush portion being wound one around the other in the same direction as the direction of twist of the first twisted core and the second twisted core.

60. The device of claim 58, wherein the first twisted core and the second twisted core each define a direction of twist, the first brush portion and the second brush portion being wound one around the other in a direction opposite to the direction of twist of the first twisted core and the second twisted core.

61. The device of claim 41, wherein the first brush portion is a right-hand brush portion and the second brush portion is a left-hand brush portion.

62. The device of claim 41, wherein the bristles of the first brush portion comprise bristles having a color differing from that of at least some of the bristles of the second brush portion.

63. The device of claim 41, wherein the first twisted core comprises two branches of a first wire and the second twisted core comprises two branches of a second wire, wherein the first wire and the second wire are substantially the same.

64. The device of claim 63, wherein at least one of the first wire and the second wire comprises iron.

65. The device of claim 41, wherein the first twisted core comprises two branches of a first wire and the second twisted core comprises two branches of a second wire, wherein the first wire and the second wire differ from each other.

66. The device of claim 41, wherein bristles of the first brush portion define at least one of a number of bristles, diameter, length, and characteristic, and bristles of the second brush portion define at least one of a number of bristles, diameter, length, and characteristic, and wherein at least one of the number bristles, the diameter, the length, and the characteristic of the bristles of the first brush portion is different from at least one of the number of bristles, the diameter, the length, and the characteristic of the bristles of the second brush portion.

67. The device of claim 41, wherein bristles of the first brush portion define at least one of a number of bristles, diameter, length, and characteristic, and bristles of the second brush portion define at least one of a number of bristles, diameter, length, and characteristic, and wherein at least one of the number of bristles, the diameter, the length, and the characteristic of the bristles of the first brush portion is substantially the same as at least one of the number of bristles, the diameter, the length, and the characteristic of the bristles of the second brush portion.

68. A system for applying a product, the system comprising:

the device of claim 41; and a container comprising a wiper, wherein the container defines an opening associated with the wiper.

69. The system of claim 68, further comprising a product contained in the container, wherein the product comprises a cosmetic product.

70. The system of claim 69, wherein the product comprises a product for applying to keratinous fibers.

71. A method of applying a product to keratinous fibers, the method comprising:

providing the system of claim 69;

loading the device with the cosmetic product; and applying the cosmetic product to keratinous fibers with the device.

72. The device of claim 41, wherein the first brush portion comprises a bristled portion and the second brush portion comprises a bristled portion, wherein the device is formed via winding the first brush portion and the second brush one around the other along at least a portion of the bristled portions of the first brush portion and the second brush portion.

73. A device for applying a cosmetic product, the device comprising:

a first brush portion comprising a first twisted core holding bristles having ends extending from the first twisted core, the first brush portion comprising a free end defined by a bristled portion of the first brush portion; and a second brush portion comprising a second twisted core holding bristles having ends extending from the second twisted core, the second brush portion comprising a free end defined by a bristled portion of the second brush portion, wherein the first brush portion and the second brush portion are wound one around the other so that over the bristled portion of at least one of the first brush portion and the second brush portion, the first twisted core and the second twisted core are twisted one relative to the other.

74. The device of claim 73, wherein the first twisted core and the second twisted core are twisted one relative to the other lying a substantially constant distance apart.

75. The device of claim 73, wherein the first twisted core is not unitary with the second twisted core.

76. The device of claim 73, wherein the free end of one of the first brush portion and the second brush portion extends beyond the free end of the other of the first brush portion and the second brush portion in the direction of an axis of the device.

77. The device of claim 73, wherein the free end of the first brush portion and the free end of the second brush portion are connected together.

78. The device of claim 73, wherein the free end of the first brush portion and the free end of the second brush portion are connected together via at least one of welding, brazing, soldering, securing with adhesive, and substantially encasing in at least one of a polymeric material and a metallic material.

79. The device of claim 73, wherein the first twisted core and the second twisted core are wound one around the other for at least one and one-half turns.

80. The device of claim 73, wherein the first twisted core and the second twisted core are wound one around the other for at least two turns.

81. The device of claim 73, further comprising a wand, wherein the first brush portion and the second brush portion are secured to the wand.

82. The device of claim 73, wherein the first brush portion and the second brush portion are right-hand brush portions.

83. The device of claim 73, wherein the first brush portion and the second brush portion are left-hand brush portions.

84. The device of claim 73, wherein the first brush portion is a right-hand brush portion and the second brush portion is a left-hand brush portion.

85. A system for applying a product, the system comprising:

the device of claim 73; and a container comprising a wiper, wherein the container defines an opening associated with the wiper.

86. The system of claim 85, further comprising a product contained in the container, wherein the product comprises a cosmetic product.

87. The system of claim 86, wherein the product comprises a product for applying to keratinous fibers.

88. A method of applying a product to keratinous fibers, the method comprising:

providing the system of claim 86;

loading the device with the cosmetic product; and applying the cosmetic product to keratinous fibers with the device.

89. A device for applying a cosmetic product, the device comprising:

a first brush portion comprising a first twisted core holding bristles having ends extending from the first twisted core; and a second brush portion comprising a second twisted core holding bristles having ends extending from the second twisted core, wherein an end of a bristled portion of the first brush portion and an end of a bristled portion of the second brush portion are connected together, wherein the first brush portion and the second brush portion are wound one around the other so that over the bristled portion of at least one of the first brush portion and the second brush portion, the first twisted core and the second twisted core are twisted one relative to the other, and wherein the first twisted core and the second twisted core are wound one around the other for at least one and one-half turns.

90. The device of claim 89, wherein the first twisted core and the second twisted core are twisted one relative to the other lying a substantially constant distance apart.

91. The device of claim 89, wherein the first twisted core is not unitary with the second twisted core.

92. The device of claim 89, wherein the end of the first brush portion and the end of the second brush portion are connected together via at least one of welding, polymeric material and a metallic material.

93. The device of claim 89, wherein the first twisted core and the second twisted core are wound one around the other for at least two turns.

94. The device of claim 89, further comprising a wand, wherein the first brush portion and the second brush portion are secured to the wand.

95. The device of claim 89, wherein the first brush portion and the second brush portion are right-hand brush portions.

96. The device of claim 89, wherein the first brush portion and the second brush portion are left-hand brush portions.

97. The device of claim 89, wherein the first brush portion is a right-hand brush portion and the second brush portion is a left-hand brush portion.

98. A system for applying a product, the system comprising:

the device of claim 89; and a container comprising a wiper, wherein the container defines an opening associated with the wiper.

99. The system of claim 98, further comprising a product contained in the container, wherein the product comprises a cosmetic product.

100. The system of claim 99, wherein the product comprises a product for applying to keratinous fibers.

101. A method of applying a product to keratinous fibers, the method comprising:

providing the system of claim 99;

loading the device with the cosmetic product; and applying the cosmetic product to keratinous fibers with the device.

102. A device for applying a cosmetic product, the device comprising:

a first brush portion comprising a first twisted core holding bristles having ends extending from the first twisted core; and a second brush portion comprising a second twisted core holding bristles having ends extending from the second twisted core, wherein the first brush portion and the second brush portion are wound one around the other for at least one turn so that over at least one bristled portion of the device, the first twisted core and the second twisted core are twisted one relative to the other, and wherein the first twisted core and the second twisted core are wound one around the other for at least one and one-half turns.

103. The device of claim 102, wherein the first twisted core and the second twisted core each comprise a plurality of bristles.

104. The device of claim 102, wherein the first twisted core is not unitary with the second twisted core.

105. The device of claim 102, wherein the first brush portion and the second brush portion each have a free end, and wherein the free end of one of the first brush portion and the second brush portion extends beyond the free end of the other of the first brush portion and the second brush portion in the direction of an axis of the device.

106. The device of claim 102, wherein the first brush portion and the second brush portion each have an end, the end of the first brush portion and the end of the second brush portion being connected together.

107. The device of claim 102, wherein the first brush portion and the second brush portion each have an end, the end of the first brush portion and the end of the second brush portion being connected together via at least one of welding, brazing, soldering, securing with adhesive, and substantially encasing in at least one of a polymeric material and a metallic material.

108. The device of claim 102, wherein the first twisted core is unitary with the second twisted core.

109. The device of claim 108, wherein the device comprises a common twisted core comprising the first twisted core and the second twisted core, wherein the first twisted core and the second twisted core are defined by a bend in the common twisted core.

110. The device of claim 102, wherein the first twisted core and the second twisted core are wound one around the other for at least two turns.

111. The device of claim 102, further comprising a wand, wherein the first brush portion and the second brush portion are secured to the wand.

112. The device of claim 102, wherein the first brush portion and the second brush portion are right-hand brush portions.

113. The device of claim 102, wherein the first brush portion and the second brush portion are left-hand brush portions.

114. The device of claim 102, wherein the first brush portion is a right-hand brush portion and the second brush portion is a left-hand brush portion.

115. A system for applying a product, the system comprising:

the device of claim 102; and a container comprising a wiper, wherein the container defines an opening associated with the wiper.

116. The system of claim 115, further comprising a product contained in the container, wherein the product comprises a cosmetic product.

117. The system of claim 116, wherein the product comprises a product for applying to keratinous fibers.

118. A method of applying a product to keratinous fibers, the method comprising:

providing the system of claim 116;

loading the device with the cosmetic product; and applying the cosmetic product to keratinous fibers with the device.

* * * * *